United States Patent [19]

Baranescu

[11] Patent Number: 4,796,577

[45] Date of Patent: Jan. 10, 1989

[54] INJECTION SYSTEM WITH PILOT INJECTION

[76] Inventor: George S. Baranescu, 5316 Howard Ave., Western Springs, Ill. 60558

[21] Appl. No.: 874,523

[22] Filed: Jun. 16, 1986

[51] Int. Cl.[4] ..... F02M 39/00

[52] U.S. Cl. ..... 123/300; 123/447

[58] Field of Search ..... 123/299, 300, 447, 446, 123/500, 501; 239/88–95

[56] References Cited

U.S. PATENT DOCUMENTS

| | | | |
|---|---|---|---|
| 3,627,208 | 12/1971 | Scott | 123/299 |
| 4,175,587 | 11/1979 | Chadwick | 123/300 |
| 4,505,244 | 3/1985 | Smith | 123/300 |
| 4,520,774 | 6/1985 | Sitter | 123/300 |
| 4,612,905 | 9/1980 | Dietrich | 123/300 |

FOREIGN PATENT DOCUMENTS

| | | | |
|---|---|---|---|
| 0083565 | 7/1981 | Japan | 123/300 |

*Primary Examiner*—Carl Stuart Miller

[57] ABSTRACT

An internal combustion engine which operates with a fuel pilot of variable amount and controllable timing whose injection is achieved independently from the injection of the main portion of the fuel charge. Both injections are achieved by the same injection pump through the same nozzle. The pilot is accumulated into the injector during the injection of the main portion of the fuel charge, and is injected in the next cycle.

20 Claims, 6 Drawing Sheets

INJECTION SYSTEM WITH PILOT INJECTION

The invention relates to an internal combustion engine which operates with pilot injection.

The pilot injection consists in dividing the fuel charge in two portions of different amounts, and injecting these portions consecutively in the combustion chamber at selected timings. The smaller portion of the fuel charge, which is injected first, is called pilot. The main portion of the fuel charge is injected in the burning gases generated by the combustion of the pilot, which brings about important improvements of engine operation.

Several methods for achieving pilot injection are known: (1) The use of two injection systems, one for the injection of the pilot, the other for the injection of the main portion of the fuel charge. (2) The use of an injection pump including two pistons for each cylinder, one for the injection of the pilot, the other for the injection of the main portion of the fuel charge through the same injector. (3) The connection of the high pressure section of the injection system to the fuel tank during injection, for a certain period of time; after the injection of the pilot the connection is opened, which stops the injection; when the injection of the main portion of the fuel charge shall start, the connection is closed. (4) The increase of the volume of the high pressure section of the injection system at a certain moment during injection. For various reasons these methods are either not practical, or do not achieve a pilot injection as defined above.

The object of the invention as described and claimed further is to provide an internal combustion engine which operates with pilot injection. The main goals of such operation are the improvement of combustion and the achievement of a significant fuel tolerance.

The engine operates with one fuel at a time. It is provided with a fuel injection system having the capacity to meter and deliver the fuel charge in two steps. First a pilot of controllable amount is injected in the combustion chamber, the timing of the pilot injection being controllable in a wide range. The engine includes also means which can achieve electric ignition of a fuel-air mixture in combustion chamber. The ignition of the pilot in the combustion chamber occurs by self-ignition when the engine operates with fuels having good or moderately low self-ignition property, and by electric ignition when the engine operates with fuels having low self-ignition property. In the latter case the timing of the pilot injection is so selected that - at the time of electric ignition - a significant portion of the pilot is vaporized and mixed with air. The main portion of the fuel charge is injected in the burning gases generated by the combustion of the pilot. This mode of operation is achieved by the accumulation of the pilot into the injector during the injection of the main portion of the fuel charge. The pilot is injected in the next cycle at a time controlled by an electromagnetic valve.

The manner in which the invention is carried into practice, the methods of operation, and further objects and advantages of the invention are set forth in the following specification, wherein the invention is described in further detail by reference to the accompanying drawing.

Figure 1:
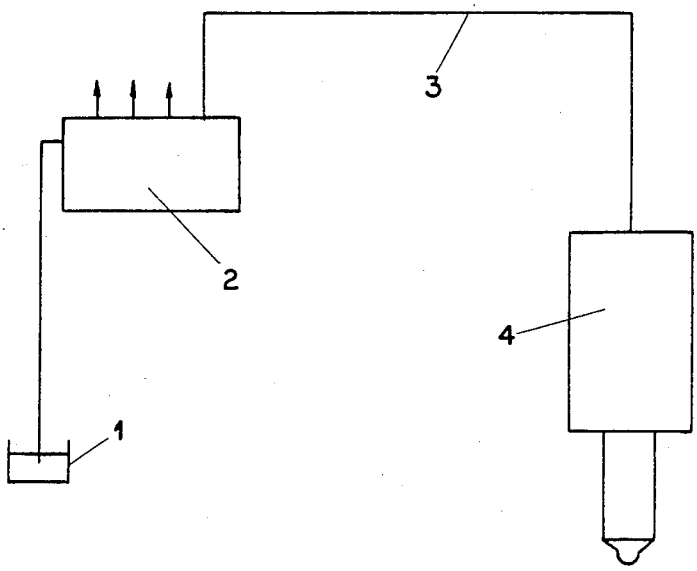
FIG. 1 shows in a schematic way the general configuration of the internal combustion engine, wherein the injection pump is connected to the injector by a high pressure line.

The general configuration of the engine is shown in a schematic way in FIG. 1. The engine includes at least one cylinder $4^{III}$ provided with the piston $4^{IV}$. The injector 4 and the means for the electric ignition are located in the cylinder head $4^{II}$. As an example the means for electric ignition shown in figure 1 consist in a spark plug $4^{I}$ connected to a spark ignition system which is not represented in FIG. 1. The injection pump 2 is connected to the fuel tank 1. This pump is also connected by means to the injector 4. As an example in FIG. 1 this connection is achieved by a high pressure line 3. A derivation $3^{II}$ allows the discharge of the high pressure section of the respective injector into fuel tank 1. The discharge is controlled by the valve $3^{I}$. The engine can have also the configuration of FIG. 2 wherein each injector 4 is provided with its own injection pump 2, incorporated with the injector.

The injection pump can be of any type. The injector includes means which allow the pilot accumulation during the injection of the main portion of the fuel charge, and the injection of the pilot in the next cycle of the injection system. Other components of the engine are shown further.

Figure 3:
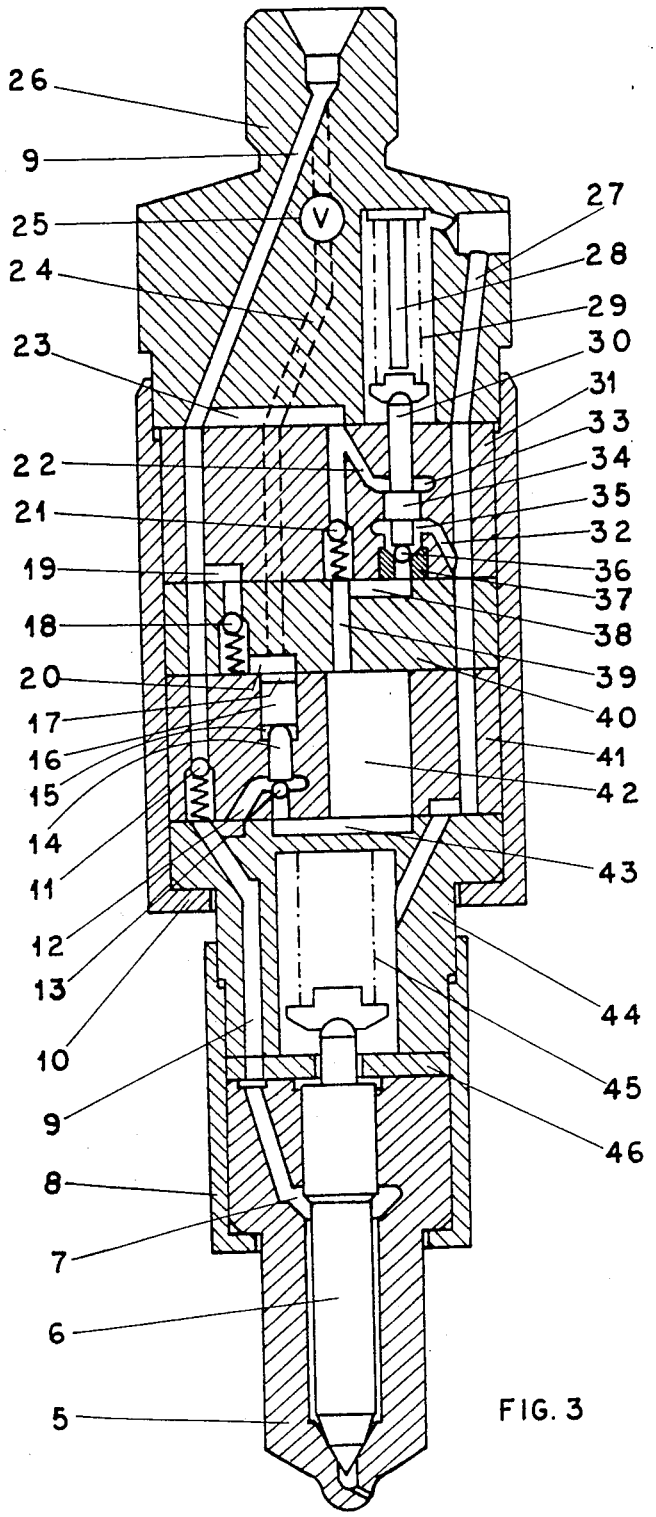
FIG. 3 represents an injector which achieves pilot injection by accumulation of the pilot, the fuel flowing from the accumulator to the nozzle through a portion of the high pressure channel of the injector.

One embodiment of the injector which achieves the accumulation and the injection of the pilot is represented in FIG. 3. The injector includes a nozzle which can be of any type having the delivery channel closed between consecutive injections. As an example in FIG. 3 the nozzle 5 includes the inward opening needle 6, actuated by spring 45, located in housing 44. The nozzle chamber 7 is connected to high pressure channel 9 of the injector, The disk 46 limits the stroke of needle 6. The injector includes also the barrels 31, 40, 41, and the upper part 26. These parts are assembled by one or several retaining nuts. As an example, two retaining nuts 8 and 10 are used in FIG. 3.

The accumulator 42, located in barrel 41, is connected with the high pressure channel 9 via channel 39, one-way check valve 21, and channel 23. The accumulator 42 is also connected with the high pressure channel 9 via discharge channel 43, valve 13 called pilot valve, and channel 12. The one-way check valve 11 is located on high pressure channel 9 just upstream from the connection between this channel and channel 12.

The pilot valve 13 can be of ball and sliding stem type as shown in FIG. 3, of needle type, or of other known type which can operate according to the requirements of the invention. The sliding stem 14 is in contact with piston 16 whose diameter is larger than the diameter of the sliding stem. When the pilot valve 13 closes channel 43 there is a clearance 17 between the piston 16 and barrel 40. The chamber above the piston 16 is connected with the high pressure channel 9 via channel 20, one-way check valve 18, and channel 19. The chamber 15 under the piston 16 is connected to the drain 27 through a channel which is not represented in FIG. 3. The control channel 24, controlled by an electromagnetic valve schematically represented by 25, connects channel 20 to high pressure channel 9.

The injector includes a valve, called control valve, which controls the pressure in the accumulator. As an example the control valve of FIG. 3 includes the seat 37 connected with the accumulator 42 via channels 38 and 39, the ball 36, piston 34 and sliding stem 30 which form together one piece, and the spring 29 which acts on sliding stem 30. The diameter of piston 34 is larger than that of sliding stem 30. The chamber 33 situated above piston 34 is in open connection with high pressure channel 9 via channels 22 and 23. The chamber 35, situated between the piston 34 and seat 37, is in open connection with the drain 27 via channel 32. The stop 28 limits the stroke of piston 34. Further, the control valve will be designated by 36.

The injection system operates as follows:

Before the start of the pilot injection the electromagnetic valve 25 is closed. The pressure in the accumulator 42, achieved during the previous cycle of the injection system, is higher than the opening pressure of the nozzle 5. The fuel pressure in channel 20 is higher than the fuel pressure in the accumulator 42 for reasons shown further. Therefore channel 43 is closed because the force which maintains the pilot valve 13 on its seat is greater than the force acting on the valve in the opposite sense. The pressure in channels 19 and 23 is the residual pressure in the high pressure channel 9, which is lower than the pressure in the accumulator 42; therefore the one-way check valves 18 and 21 are closed.

When the injection of the pilot shall start the electromagnetic valve 25 opens the control channel 24. As a result channel 20 discharges into channel 9, the pressure which maintains the pilot valve 13 on its seat decreases, and this valve opens. Consequently fuel from the accumulator 42 flows into high pressure channel 9 via channel 43, pilot valve 13, and channel 12. Because the incoming fuel cannot flow upstream from the one-way check valve 11, the pressure in channel 9 downstream from this valve, and the pressure in the nozzle chamber 7 increase. The nozzle opens and the injection of the pilot starts. This injection ends when the fuel pressure in the accumulator 42, in channels 43 and 12, in the portion of channel 9 situated downstream from the one-way check valve 11, and in the nozzle chamber 7 becomes lower but near to the closing pressure of the nozzle 5. After the closing of the nozzle the one-way check valve 11 remains closed, because the fuel pressure upstream from this valve, which is the residual pressure in channel 9, is lower than the fuel pressure downstream from the valve.

The injection of the pilot occurs as described above if the pressure in the accumulator at the opening of valve 13, and the volume of the accumulator, are so that a certain amount of fuel flows from the accumulator towards the nozzle chamber. This amount of fuel must increase the pressure in the volume downstream from the accumulator at least up to the opening pressure of the nozzle. If the injection system is designed to deliver a pilot at any operating regime of the engine, the accumulator must have a volume large enough to satisfy the above condition, even for that operating regime wherein the lowest pressure in the accumulator is achieved. With a smaller volume of the accumulator the injection system delivers a pilot only in those operating regimes wherein the pressure in the accumulator is a least equal to the minimum pressure necessary for the opening of the nozzle.

When the combustion of the most part of the pilot has occurred the injection pump starts to deliver fuel towards the injector, which increases the fuel pressure in high pressure channel 9 upstream from the one-way check valve 11. Also the pressure in channels 19, 23, 22, and in chamber 33 increases, since they are in open connection with high pressure channel 9. Valve 18 opens and fuel from high pressure channel 9 flows into channel 20 pushing down the piston 16 until the pilot valve 13 closes channel 43; the closing of channel 43 occurs before the fuel pressure in channel 20 becomes equal to the fuel pressure in the accumulator 42, because the diameter of piston 16 is larger than the diameter of sliding stem 14. If the electromagnetic valve is still opened at the time when the injection pump starts to deliver fuel towards the injector, fuel from channel 9 can also flow into channel 20 via channel 24.

When the pressure in channel 9 becomes higher than the pressure in the accumulator 42 and in the section of the high pressure channel 9 situated downstream from one-way check valve 11, the one-way check valves 21 and 11 open. Consequently, fuel from channel 9 flows into accumulator 42 via one-way check valve 21, and channel 39. This fuel flow increases the pressure in the accumulator 42 since at that time channel 43 is closed by the pilot valve 13. A smaller amount of fuel flows into channel 9 downstream from one-way check valve 11, which increases the fuel pressure in the nozzle chamber 7.

When the fuel pressure in nozzle chamber 7 reaches the necessary value, nozzle 5 opens and the injection of the main portion of the fuel charge starts. This injection occurs in an environment whose pressure, temperature and concentration of reactive particles are significantly higher than in a conventional diesel engine, because of the previous combustion of the pilot. Therefore, the ignition delay is short, and the combustion occurs with low rates of pressure rise.

During the injection of the main portion of the fuel charge the fuel flow into accumulator 42 continues until the pressure in high pressure channel 9 reaches its maximum for the respective cycle of the injection system. The subsequent decrease of the fuel pressure in high pressure channel 9 closes the one-way check valve 21. At this moment the accumulation of the pilot ends.

The injection of the main portion of the fuel charge continues after the accumulation of the pilot terminates, because the injection pump continues to deliver fuel towards the injector. When the injection pump ends the fuel delivery towards the injector, the fuel pressure in high pressure channel 9 drops and the one-way check valve 11 closes. The injection continues until the fuel pressure in the nozzle chamber 7 decreases under the closing pressure of the nozzle 5. At that time the injection of the main portion of the fuel charge ends. The pressure of the fuel trapped downstream from one-way check valve 11 at the closing of the nozzle 5 is lower but near to the closing pressure of the nozzle.

The electromagnetic valve 25 shall be closed at or before the moment when the fuel pressure in high pressure channel 9 has decreased to the minimum pressure which maintains the pilot valve 13 closed. Otherwise the pilot valve 13 will be opened by the difference between the fuel pressure in channels 43 and 20, which generates the injection of the pilot at the wrong time. The increase of the cross section of piston 16 allows a later closing of the electromagnetic valve 25, therefore a slower acting valve.

The control valve 36 remains closed during the injection of the main portion of the fuel charge since this valve is so designed that—during the injection of the main portion of the fuel charge - the force of spring 29 together with the force generated on piston 34 by the pressure of the fuel of chamber 33, are greater than the force generated on the ball 36 by the fuel pressure in the accumulator 42.

The decrease of the fuel pressure in high pressure channel 9 after the end of injection decreases the force which holds the control valve 36 closed. At a certain value of the fuel pressure in channel 9 the control valve 36 opens. A portion of the fuel accumulated in the volume 42 is discharged into drain 27 via channel 32. This process ends when the pressure in the accumulator 42 generates on valve 36 a force smaller than the sum of the force of spring 29 and the force generated on piston 34 by the residual pressure of the fuel of chamber 33. Because of this discharge the pressure in the accumulator 42 is lower than the pressure in channel 20 at the beginning of the next cycle of the injection system, as previously mentioned.

Due to the described operation of the control valve 36 the pressure in the accumulator 42 increases when the load and speed of the engine increases. This happens because the pressure in the accumulator 42 at the closing of the control valve 36 depends on the residual pressure in high pressure channel 9, and this pressure increases with the load and speed of the engine. Therefore the amount of pilot is variable. It increases with the load and speed, which is in accord with the requirements of the engine.

Figure 2:
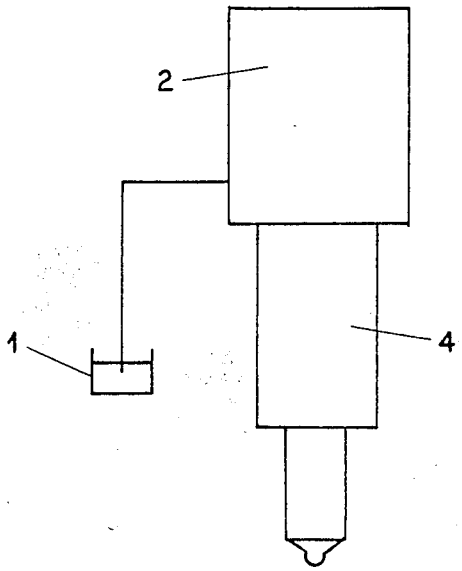
FIG. 2 shows in a schematic way the general configuration of the internal combustion engine, wherein each injector is provided with its own injection pump incorporated with the injector.

If the high pressure section of the injection system is fully discharged between consecutive injections, the amount of pilot is constant, because the accumulator discharges down to the same pressure at any operating regime of the engine. The pressure in the accumulator at the end of the discharge is determined only by the force of the spring 29. The discharge of the high pressure section of the injection system is accomplished by connecting this section to the fuel tank between consecutive injections. This connection can be achieved through and controlled by the injection pump, or through a line opened and closed by a valve at selected moments, as shown in FIGS. 1 and 2.

The pilot accumulated as described above is injected in the next cycle. The timing of the pilot injection can be modified in a large range, because this timing is determined by the opening of the electromagnetic valve 25 which is easy to modify. The operation of this valve can be electronically programmed which allows the optimization of the timing of pilot injection over the entire load and speed range.

The variation of the amount of the pilot can be tailored by the control of the residual pressure in the high pressure channel 9, and by the selection of the force of spring 29.

The residual pressure in the high pressure channel can be controlled to some extent by the design of the delivery valve of the injection pump.

The force of the spring 29 can be selected so that the control valve 36 opens at any operating regime of the engine. In this case the variation of the amount of the pilot depends only on the variation of the residual pressure in high pressure channel 9. If a higher spring force is selected, the control valve 36 opens only in certain operating regimes of the engine. In this case the increase of load and speed generate a different variation of the amount of pilot: a faster increase as long as the control valve cannot be opened, and a slower increase for the operating regimes wherein the pressure in the accumulator is high enough for the opening of the control valve 36.

Another way for tailoring the amount of the pilot is to provide the control valve 36 with several springs, for example two springs having different characteristics, and located so that the second spring acts on the sliding stem 30 only after this stem has completed a portion of its stroke.

Figure 4:
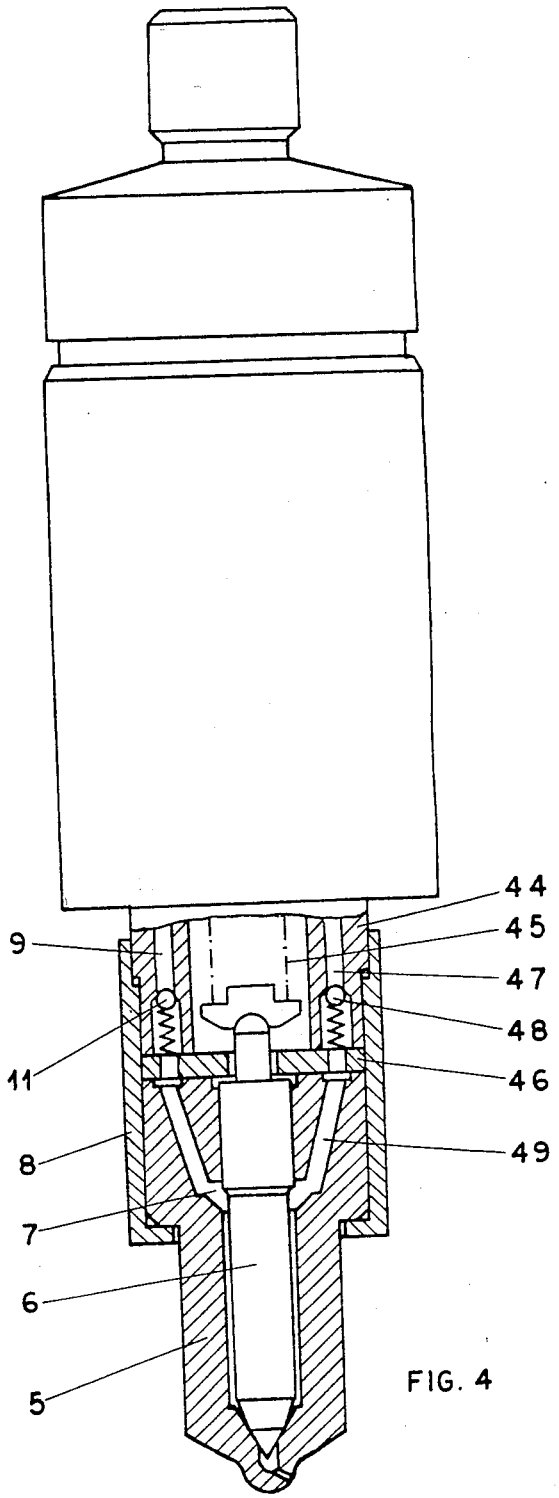
FIG. 4 represents an injector which achieves pilot injection by accumulation of the pilot, the fuel flowing from the accumulator to the nozzle through a separate channel.

To shorten the duration of the portion of the injection which occurs after the closing of one-way check valve 11, the volume downstream from this valve shall be reduced. One of the possible methods is shown in FIG. 4. The accumulator is connected with the nozzle chamber 7 by the additional channels 47 and 49. Channel 47, which has no connection with high pressure channel 9, is provided with the one-way check valve 48. The location of one-way check valve 11 of FIG. 3 is changed as shown in figure 4. When the injection pump ends the fuel delivery towards the injector the one-way check valve 11 closes. The injection continues until the pressure of the fuel trapped in the volume downstream from the one-way check valves 11 and 48 decreases under the closing pressure of the nozzle. Because this volume is smaller than that of the injector represented in FIG. 3, the last portion of the injection is shorter.

For some applications it is necessary to prevent a residual pressure in nozzle chamber 7 and in the entire high pressure channel 9. This is not possible with the injectors represented in FIGS. 3 and 4, because the pressure in the volume downstream from one-way check valve 11 cannot be discharges by the injection pump, due to the presence of this valve.

Figure 5:
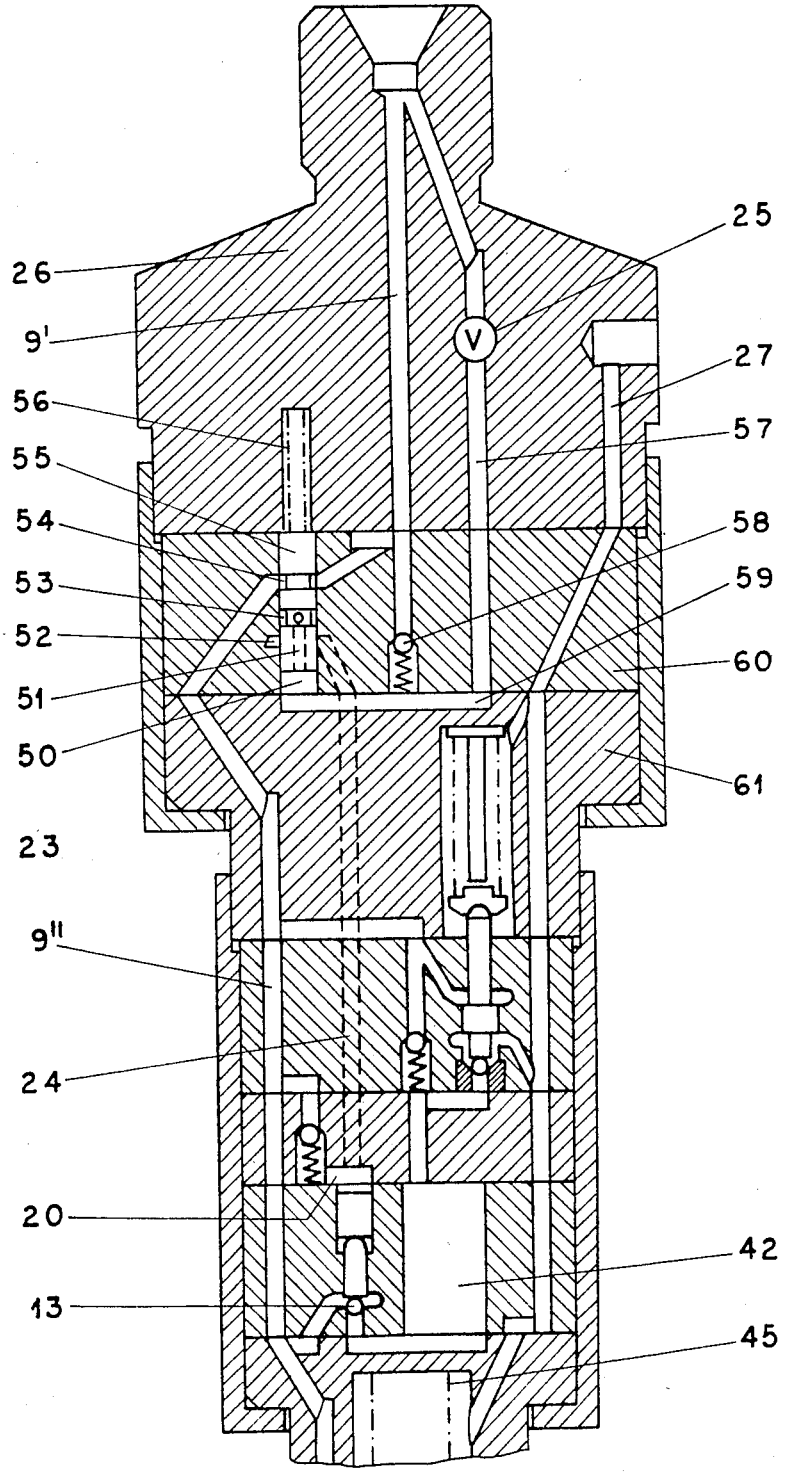
FIG. 5 represents an injector which achieves pilot injection by accumulation of the pilot, the injector including means which closes the high pressure channel of the injector upstream from the connection between the accumulator and the high pressure channel during the injection of the pilot, and allows the discharge of this channel at the end of injection.

FIG. 5 shows a variant of the injector of FIG. 3 which includes means that allow the discharge of nozzle chamber and the high pressure channel at the end of the injection of the main portion of the fuel charge. The injector includes two additional barrels 60 and 61, and the sliding valve 55 actuated by the spring 56. The sliding valve 55 includes the groove 53 connected with chamber 50 by channel 51, and the groove 54. Barrel 60 includes groove 52 which is in open connection with chamber 20 via control channel 24. The upper section 9' of the high pressure channel is connected with the chamber 50 via one-way check valve 58 and channel 59, as well as via the electromagnetic valve 25, and channels 57 and 59. The chamber of spring 56 is connected to drain 27; this connection is not shown in FIG. 5. The one-way check valve 11 of FIG. 3 is eliminated.

The sliding valve 55 operates as follows. Before the injection of the pilot the electromagnetic valve 25 is closed, and the sliding valve is in contact with the upper part 26 of the injector, which acts as the upper stop. The valve is maintained in this position because chamber 50 is filled with high pressure fuel from the previous injection cycle. The groove 54 connects the upper section 9' and the lower section 9'' of the high pressure channel. Both sections have been fully discharged from the end of the previous injection.

For starting the injection of the pilot the electromagnetic valve 25 is opened. As a result the fuel of channel 57 discharges into upper section 9' of the high pressure channel, which decreases the pressure in chamber 50. The spring 56 pushes down the sliding valve 55 until this valve contacts barrel 61 which acts as the lower stop. The relative position of grooves 53 and 54 is so that—during the motion of the sliding valve 55 from the upper to the lower stop—first the two sections 9' and 9'' of the high pressure channel are disconnected, and then groove 53 is connected with groove 52. When the sliding valve 55 is on its lower stop, grooves 52 and 53 are in full connection.

The connection between grooves 52 and 53 allows the discharge of chamber 20 into upper section 9' of the high pressure channel via channel 24, grooves 52 and 53, channel 51, chamber 50, channels 59 and 57, and electromagnetic valve 25. Consequently the pilot valve 13 is opened, the accumulator 42 discharges towards the nozzle chamber, the nozzle opens, and the pilot is injected. During this process the accumulator 42 cannot discharge into the upper section 9' of the high pressure channel because these two sections are disconnected by the sliding valve 55.

When the injection pump delivers fuel towards the injector the fuel pressure in the upper section 9' of the high pressure channel increases, and fuel flows from the section 9' into cylinder 50 via one-way check valve 58 and channel 59, as well as via electromagnetic valve 25 and channels 57 and 59 if the electromagnetic valve 25 is still open at that time. The sliding valve 55 moves up until it contacts its upper stop. After the closing of groove 52, groove 54 connects the two sections 9' and 9'' of the high pressure channel, which allows a fuel flow towards the nozzle chamber. Further, the injection of the main portion of the fuel charge and the accumulation of the pilot occur as described in connection with FIG. 3.

The electromagnetic valve 25 shall be closed at or before the moment when the pressure in the upper section 9' of the high pressure channel has decreased to the minimum pressure which maintains the sliding valve 55 in contact with its upper stop.

Figure 6:
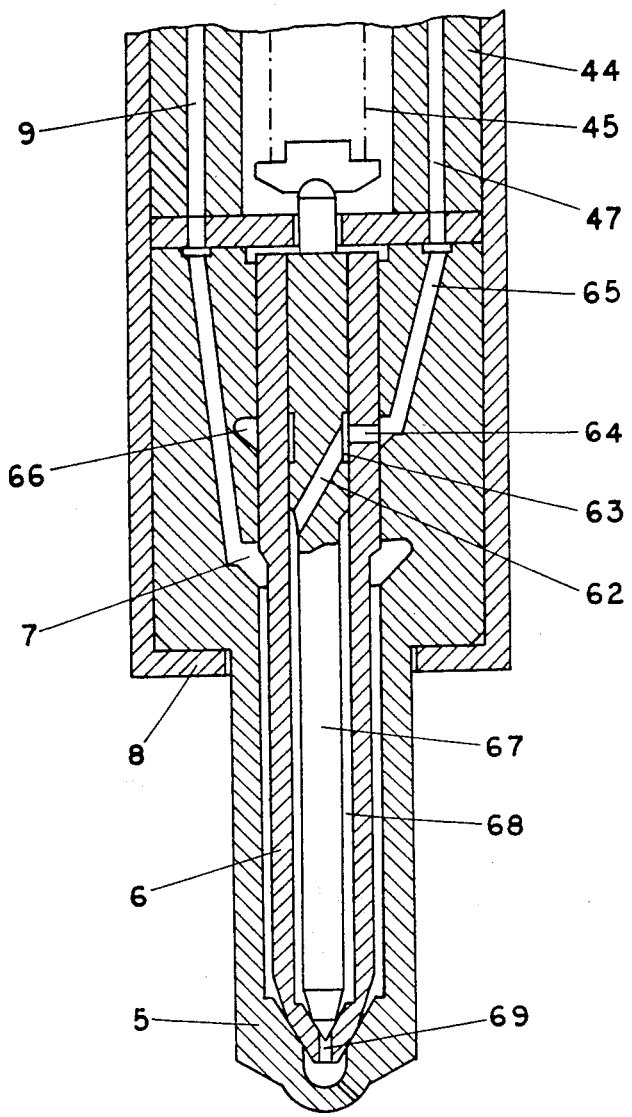
FIG. 6 represents an injector which achieves pilot injection by accumulation of the pilot, wherein the injection of the pilot into the combustion chamber is achieved through a delivery channel located in nozzle needle, which is opened and closed by a second needle located inside the nozzle needle.

Another embodiment of the injector which achieves the pilot injection, and allows the discharge of the nozzle chamber and the high pressure channel after the end of injection, is shown in FIG. 6. In this figure only the nozzle and the adjacent portion of the housing 44 have been represented. All the other parts of the injector are those shown in FIG. 3, excepting the following: (1) the one-way check valve 11 is eliminated, and (2) channel 12 is not connected to high pressure channel 9, but to a separate channel 47 as in the injector represented in FIG. 4.

The nozzle 5 is provided with two coaxial needles: the exterior needle 6 whose chamber 7 is in open connection with high pressure channel 9, and the interior needle 67 whose chamber 68 is connected with channel 47 via channel 62, groove 63, channel 64, groove 66, and channel 65. A second delivery channel 69 controlled by the interior needle 67 is located in the exterior needle 6 as shown in FIG. 6. Grooves 63 and 66 are so designed that channels 64 and 65 remains connected to grooves 63 and 66, respectively, whichever the axial positions of needles 6 and 67. The spring 45 acts on needle 67; when this needle closes channel 69, the force of spring 45 is transmitted to needle 6.

The engine provided with the injector represented in FIG. 6 operates as follows.

When the accumulator is opened as described in connection with FIG. 3, fuel is discharged into channel 47, the fuel pressure in chamber 68 increases, needle 67 moves up, and the injection of pilot occurs through channel 69. As long as channel 69 is open the force of the spring 45 is not transmitted to needle 6; however, this needle remains on its seat under the force generated on the needle by the pressure of the fuel of chamber 68. When the pressure in chamber 68 decreases under the closing pressure of needle 67, channel 69 is closed and the injection of the pilot ends.

When the injection pump delivers fuel towards the injector the fuel pressure in channel 9 and chamber 7 increases, needle 6 moves up together with needle 67, and the injection of the main portion of the fuel charge occurs.

Because channels 9 and 47 are connected to different chambers, the injection of the pilot does not require the temporary closing of high pressure channel 9. Therefore the one-way check valve 11 of FIG. 3 is not necessary; this valve was eliminated as previously mentioned. Consequently chamber 7 and high pressure channel 9 can be discharged by the injection pump after the end of injection. The method for the injection of the pilot shown in FIG. 6 can be considered for engines using nozzles which allows the provision of the interior needle 68.

Figure 7:
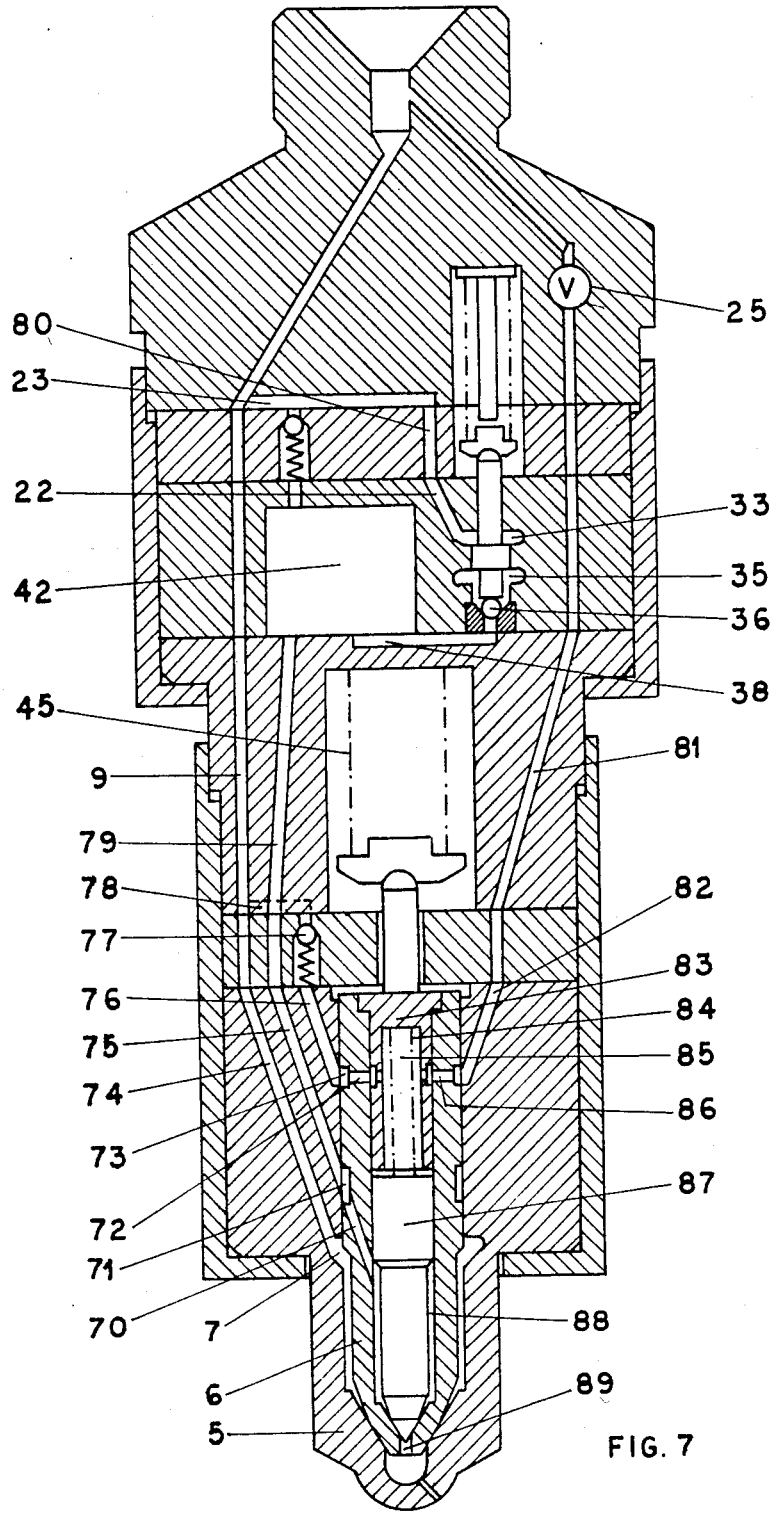
FIG. 7 represents an injector which achieves pilot injection by accumulation of the pilot, wherein the injection of the pilot into the combustion chamber is achieved through a delivery channel located in nozzle needle, which is opened and closed by a second needle located inside the nozzle needle, the pressure chamber of the second needle being in open connection with the accumulator.

Another embodiment of the injector which achieves the pilot injection is represented in FIG. 7. The injector includes the nozzle 5 provided with two coaxial needles 6 and 87. The chamber 7 of needle 6 is in open connection with high pressure channel 9 via channel 74. The chamber 88 of the interior needle 87 is in open connection with the accumulator 42 via channel 70, groove 71, and channels 75 and 79. The exterior needle 6 is assembled with the part 83 which serves as a stop for the interior needle 87, and houses the spring 84 of this needle. The spring 45 acts on part 83. Chamber 85 of spring 84 is connected to high pressure channel 9 via channel 72, groove 73, channel 76, one-way check valve 77, and channel 78, as well as via channel 86, grove 73, channels 82 and 81, and the electromagnetic valve 25. The control valve 36 has the same design as in FIG. 3. Chamber 33 of this valve is connected to high pressure channel 9 via channels 22, 80, and 23. The connection of chamber 35 to the drain, and the drain itself, are not represented in FIG. 7. The parts common to FIGS. 3, 5, and 7 bear the same number.

The engine provided with the injector of FIG. 7 operates as follows.

Before the start of the injection of pilot both needles are on their seats. Needle 6 is maintained on its seat by the force of spring 45. Needle 87 is maintained on its seat by the force of spring 84, and by the force generated on the top of the needle by the pressure of the fuel trapped in chamber 85 during the previous injection. These two forces are together greater than the force generated on the needle by the pressure of the fuel of chamber 88, because this pressure (the accumulator pressure) is lower than the pressure in chamber 85, and acts on a smaller area.

When the injection of the pilot shall start the electromagnetic valve 25 is opened. As a result fuel from channel 81 discharges into high pressure channel 9 which lowers the pressure in chamber 85 down to the residual pressure in high pressure channel 9. The needle 87 moves upwards, the second delivery channel 89 is opened, and the injection of the pilot starts. When the pressure in chamber 88 decreases under the closing pressure of needle 87, the second delivery channel 89 is closed, and the injection of the pilot ends. Subsequently the electromagnetic valve 25 is closed.

When the injection pump starts to deliver fuel towards the injector, the fuel pressure in chamber 7 increases, needle 6 moves upwards together with needle 87, and the injection of the main portion of the fuel charge as well as the accumulation of the pilot occur as described in connection with FIG. 3. During this process fuel from high pressure channel 9 flows into chamber 85 via channel 78, one-way check valve 77, channel 76, groove 73, and channel 72, which increases the fuel pressure in this chamber, as well as in channels 82 and 81. After the moment when the pressure in channel 9 reaches its maximum value for the respective cycle of the injection system valve 77 closes and the fuel flow into chamber 85 ends. The fuel trapped in this chamber maintains the second delivery channel 89 closed until the next opening of the electromagnetic valve 25.

The engine can operate without the control valve. In this case the accumulator is not discharged after the injection of the main portion of the fuel charge.

All the described embodiments of the injection system can be designed and operated to deliver a pilot either at any operating regime of the engine, or only in those operating regimes wherein the fuel pressure in the accumulator is equal or higher than a predetermined pressure.

In all the embodiments previously described the vertical channels have been represented with their axes in the same plane for the description purpose. Actually, these channels are located around the injector axis, for decreasing the size of the injector.

The use of several retaining nuts for the assembling of the parts of the injector allows the increase of the diameter of the barrels located above the housing 44 of the nozzle spring 45, because the portion of the injector where the barrels are located is situated above the cylinder head of the engine. The nozzle 5 and the adjacent portion of the housing 44 can be of usual size. Therefore the use of the injectors previously described does not require the modification of the cylinder head of the engine.

The parts which ensure the accumulation and the injection of the pilots can be located not only as shown in the described embodiments, buy also in other different ways. For example the control valve 36 may be located above the housing 44 in an inverse position for allowing the actuation of the piston 30 by the nozzle spring 45. Also different number of barrels can be used.

The internal combustion engine according to the invention has several advantages. It can operate with pilot injection without the discharge of the injection pump during the injection process, which allows the use of an injection pump of conventional size. The amount of the pilot can be increased as the engine load and speed increases. This capacity ensures a near constant ignition delay (expressed in crank angle degrees) of the main portion of the fuel charge over the load and speed range. As a result the engine can operate in a broad speed range, with moderate rates of pressure rise, low noise and gaseous emissions, and higher mechanical efficiency.

The delivery timing of the pilot is controllable in large limits, and the control can be achieved electronically in a simple way. Therefore the engine can be electronically programmed, which allows the automatic optimization of engine operation over the load and speed range.

The broad variation of the timing of the pilot allows the ignition of the pilot in diesel mode, when fuels having good or moderately low self-ignition property are used. For fuels having low self ignition property the pilot is electrically ignited. The environment created in the combustion chamber by the combustion of the pilot ensures the ignition and combustion of the main portion of the fuel charge for a large range of fuels. Therefore, the internal combustion engine according to the invention has a significant fuel tolerance.

The injection system is retrofitable to the existing diesel engines because its implementation does not require structural modifications of the engine.

The foregoing specification of the invention has been referred to certain configurations and methods of operation, it being understood that many other configuration and methods of operation are possible within the essence and the scope of the invention.

I claim:

1. An internal combustion engine having at least one cylinder, each cylinder being provided with an injector which includes a nozzle whose delivery channel in opened and closed by a valve actuated by the nozzle spring, said injector including also a drain, and a high pressure channel connected by means with an injection pump and with the nozzle, the injection pump being connected to a fuel tank, said internal combustion engine being characterized by several capacities including the division of the fuel charge of each cycle in two portions of different amount, which are injected sequentially through the same injector, starting with the smaller portion which acts as a pilot for the main fuel charge, the two sequential injections being achieved by the same injection pump, through the storage of the pilot in an accumulator located inside the injector, the storage occuring during the injection of the main fuel charge, the accumulated pilot being injected by fuel expansion in the cycle following its accumulation, at controllable timing and in controllable amount, the main fuel charge being delivered by the injection pump at controllable timing and in controllable amount, when the temperature and pressure in the combustion chamber have substantially increased due to the combustion of the pilot, these capacities of the engine being achieved by means including an accumulator connected with the high pressure channel, and with the nozzle, means which control the connection between the high pressure channel and the accumulator, means which control the timing of pilot injection, this timing being electronically programmed, means which prevent a fuel flow from the accumulator towards the injection pump during the injection of the pilot, means which control the fuel pressure in the accumulator, means which control the residual pressure in high pressure channel, means for the electric ignition of the pilot, when the engine operates with fuels having low self-ignition property.

2. An internal combustion engine as defined in claim 1, wherein said means which control the connection between the high pressure channel and the accumulator include a one-way check valve.

3. An internal combustion engine as defined in claim 2, wherein the connection between the accumulator and the nozzle includes a portion of the high pressure channel.

4. An internal combustion engine as defined in claim 2, wherein the accumulator is connected to the nozzle through a separate channel.

5. An internal combustion engine as defined in claim 3, wherein said means which control the timing of pilot injection include a pilot valve, located on the connection between the accumulator and the nozzle, said pilot valve including a chamber connected to the high pressure channel through a channel provided with a one-way check valve, as well as through a control channel provided with an electromagnetic valve, said pilot valve being closed by the pressure of the fuel trapped in said chamber of this valve during the period of time wherein the injection pump delivers fuel towards the injector, and opened by the fuel pressure of the accumulator when said electromagnetic valve connects the control channel with high pressure channel, the opening and closing of the electromagnetic valve being electronically programmed.

6. An internal combustion engine as defined in claim 5, wherein said means which prevent a fuel flow from the accumulator towards the injection pump during the injection of the pilot include a one-way check valve located on high pressure channel, upstream from the connection between this channel and said discharge channel.

7. An internal combustion engine as defined in claim 5, wherein said means which prevent a fuel flow from the accumulator towards the injection pump during the injection of the pilot include a sliding valve that separates the high pressure channel in two sections, which are connected and disconnected as the sliding valve is in contact with its upper or lower stop, respectively, said sliding valve separates also said control channel in two sections in a location situated between said chamber of the pilot valve and the electromagnetic valve, the two sections of the control channel being connected and disconnected as the sliding valve is in contact with its lower or upper stop, respectively, said sliding valve being moved from the lower to the upper stop by a fuel flow from the upstream section of the high pressure channel when the injection pump delivers fuel towards the injector, this fuel flow occurring through a channel provided with a one-way check valve, and is moved back to the lower stop by a spring when the electromagnetic valve of said control channel connects this channel with the upstream section of the high pressure channel, said sliding valve being so designed that - when this valve moves from the upper to the lower stop - first the two sections of the high pressure channel are disconnected, and then the two sections of the control channel are connected.

8. An internal combustion engine as defined in claim 4, wherein said means which control the timing of pilot injection include a pilot valve located on the connection between the accumulator and the nozzle, said pilot valve including a chamber connected to the high pressure channel through a channel provided with a one-way check valve, as well as through a control channel provided with an electromagnetic valve, said pilot valve being closed by the pressure of the fuel trapped in said chamber of this valve during the period of time wherein the injection pump delivers fuel towards the injector, and opened by the fuel pressure of the accumulator when said electromagnetic valve connects the control channel with high pressure channel, the opening and closing of the electromagnetic valve being electronically programmed.

9. An internal combustion engine as defined in claim 8, wherein said means which prevent a fuel flow from the accumulator towards the injection pump during the injection of the pilot include a one-way check valve located on the high pressure channel close to the nozzle, said separate channel which connects the accumulator to the nozzle including a one-way check valve located close to the nozzle.

10. An internal combustion engine as defined in claim 8, wherein said valve of the nozzle is of needle type, said means which prevent a fuel flow from the accumulator towards the injection pump during the injection of the pilot include a second needle located coaxially with and inside of the nozzle needle, said second needle, that is actuated by the nozzle spring, delimits inside the nozzle needle a chamber which is connected with said pilot valve through said separate channel so that the connection remains open for any relative position of the two needles, said second needle controlling the connection between said chamber delimited by this needle inside the nozzle needle and a second delivery channel located in nozzle needle.

11. An internal combustion engine as defined in claim 2, wherein said valve of the nozzle is of needle type, said means which allow the injection of the pilot into said combustion chamber and control the timing of pilot injection include a second needle located coaxially with and inside of the nozzle needle, said second needle delimiting inside the nozzle needle a chamber which is in open connection with the accumulator, also in connection with a second delivery channel located in nozzle, the second delivery channel being opened and closed by the second needle, said second needle being actuated by a spring located in nozzle needle inside of a part which is asembled with the nozzle needle, said part being actuated by the nozzle spring and acting as a stop for the second needle, the chamber of the spring of the second needle being connected with the high pressure channel through a channel provided with a one-way check valve, as well as through a control channel provided with an electromagnetic valve whose operation is electronically programmed.

12. An internal combustion engine as defined in any one of claims 6, 7, 9, 10, and 11, wherein said means which control the fuel pressure in the accumulator include a control valve which controls a connection between the accumulator and said drain, the pressure of the accumulator generating on the control valve a force acting in the sense of valve opening, the control valve including a chamber which is in open connection with the high pressure channel, the pressure of the fuel of this chamber generating on the control valve a force acting in the sense of valve closing, the control valve being actuated by at least one spring or by said nozzle spring, whose force acts in the sense of valve closing, said control valve being so designed that the forces acting on the valve maintain the control valve closed during the injection of the main portion of the fuel charge, and open the control valve after the injection of the main portion of the fuel charge, which allows the partial discharge of the accumulator into the drain, until the pressure in the accumulator decreases so that the control valve is closed again.

13. An internal combustion engine as defined in claim 12, wherein the accumulator is designed to deliver a pilot at any operating regime of the engine.

14. An internal combustion engine as defined in claim 13, which includes a connection of the high pressure section of the injection system to the fuel tank, said connection being achieved through and controlled by the injection pump.

15. An internal combustion engine as defined in claim 13, which includes a connection of the high pressure section of the injection system to the fuel tank, said connection being achieved by a line opened and closed by a valve at selected moments.

16. An internal combustion engine as defined in claim 12, wherein the accumulator is designed to deliver a pilot in the operating regimes of the engine wherein the maximum fuel pressure during the injection is at least equal to a predetermined pressure.

17. An internal combustion engine as defined in claim 16, which includes a connection of the high pressure section of the injection system to the fuel tank, said connection being achieved through and controlled by the injection pump.

18. An internal combustion engine as defined in claim 16, which includes a connection of the high pressure section of the injection system to the fuel tank, said connection being achieved by a line opened and closed by a valve at selected moments.

19. An internal combustion engine as defined in claim 1, wherein said means which control the fuel pressure in the accumulator, are eliminated.

20. An internal combustion engine as defined in any one of claims 6, 7, 9, 10 and 11, wherein said means which control the fuel pressure in the accumulator are eliminated.

* * * * *